United States Patent [19]

Bowen

[11] 4,127,905

[45] Dec. 5, 1978

[54] BATHING FACILITY

[76] Inventor: Duane C. Bowen, 2551 State St., Carlsbad, Calif. 92008

[21] Appl. No.: 475,404

[22] Filed: Jun. 3, 1974

[51] Int. Cl.[2] ..... A47K 3/04; A47K 3/16

[52] U.S. Cl. ..... 4/148

[58] Field of Search ..... 4/161, 162, 146, 148, 4/153, 154, 173, 2, 45, 175

[56] References Cited

U.S. PATENT DOCUMENTS

| | | | |
|---|---|---|---|
| 1,739,622 | 12/1929 | Wallace | 4/146 X |
| 2,374,490 | 4/1945 | Lehman | 4/148 X |
| 3,037,555 | 6/1962 | Kochanowski | 4/154 X |
| 3,110,907 | 11/1963 | King | 4/2 |
| 3,158,237 | 11/1964 | Schooler | 4/173 X |
| 3,479,778 | 11/1969 | Johnson | 4/173 X |
| 3,757,358 | 9/1973 | Chisholm et al. | 4/146 |
| 3,864,760 | 2/1975 | Bowen | 4/146 |

FOREIGN PATENT DOCUMENTS

| | | | |
|---|---|---|---|
| 956151 | 4/1964 | United Kingdom | 4/146 |

OTHER PUBLICATIONS

"The New Circle Shower by Swan", Susan Corp., AIA File No. 29 H-3.

*Primary Examiner*—Charles E. Phillips
*Attorney, Agent, or Firm*—Duane C. Bowen

[57] ABSTRACT

The space over a shower or tube enclosure, of the type made in one-piece of fiber-reinforced plastic and having walls extending up to about the level of a rail supporting sliding doors, is closed with a dome and a wall extending from the rail to the bathroom ceiling, so that no finish is required over studs and ceiling joists in that space and so that warm and moisture-laden air can't escape from the enclosure, via that space, into the remainder of the bathroom.

11 Claims, 6 Drawing Figures

BATHING FACILITY

BRIEF SUMMARY OF THE INVENTION AND OBJECTIVES

My invention relates to an improvement in a one-piece shower or tub enclosure of the type made of fiber-reinforced plastic and having walls extending up to about the level of a rail supporting sliding doors. The space above the enclosure is closed with a dome and a wall extending from the rail to the ceiling.

This invention is a further improvement over my prior patent application Ser. No. 247,795, filed 4/26/72, entitled "Improvement in Bathing Facility" issued 2/11/75 as U.S. Pat. No. 3,864,760. The patent was also concerned with preventing escape of warm and vapor-laden air from a bathing facility into a bathroom. The prior application, however, was not concerned with full integration into the variety of bathing facility described above or with avoiding the normal costs of finishing above the bathing facility.

As will be observed from my prior patent application, I have been concerned with the discomfort in a tub or shower, closed by sliding doors, due to escape of warm air over the rail supporting the doors. Warm air rises and is replaced by cooler air. This means that air heated by warm water in a tub or warm water from a shower continuously rises and escapes over the rail and cold air replaces it, not only exposing the bather to the colder air but also exposing him to the air movement which has a cooling effect. Persons liking a longer warm tub or shower will be more sensitive to loss of warm air than "in-and-out" bathers. This model of bathing facility, closed with shower doors supported by rails, appears to have been the most widely sold and installed type of bathing facility for some time, and it is puzzling why this deficiency in bathing facilities has not been comprehended before and why something has not been marketed to solve the problem. It is an objective of my invention to provide means to prevent warm, vapor-laden air from passing out of a bathing facility over such rail.

A second objective is to confine moisture-laden air to the bathing facility as much as is feasible, because such moisture condenses on mirrors obscuring them and also condenses on other surfaces which can lead to soiling or deterioration, such as to wall treatments and particularly to any wallpaper used. This is not to say my invention prevents all escape of moisture, because some will leak around and between sliding doors (and, in fact, a prefectly air-tight bathing facility could not be used because oxygen could be exhausted from the air) and because some vapor will escape as the sliding doors are opened (although this will be reduced if the doors are promptly closed after leaving the bathing facility). The extent of reduction of apparent steaming of the bathroom outside of the bathing facility will depend on various factors, as indicated.

One consideration is providing a top for a shower or bath of the type described is cost. Although an "add-on" top (as described in my prior, referenced patent application) can be of relatively low cost, expense can be a consideration and particularly to a real estate developer who has to choose among various desirable additional features in building a number of houses, i.e., sound systems, built-ins such as bookcases, paneling, alarm systems, central vacuum systems, inner and outer architectural features, etc. A very important feature of the present invention is providing a shower or bath top that will at least partly or wholly pay for itself in avoiding the requirement of tedious and expensive wall finishing above a shower or bath of the type described. This means the builder can provide a desirable feature without increasing costs. It is an objective of my invention to provide a top for a shower or bath of the type described (fiber-reinforced plastic with back and end walls extending up to about the rail height) that will save about the cost of the top by avoiding need for wall finishing above the shower or bath.

The variety of shower or bth specified is formed on a male mold. When only bottom, back and end walls are required, mold removal is not a problem. When a top surface, and particularly a domed top is provided, then mold removal would be a problem in a one-piece molding. This may be one reason this type of shower or bath has not been provided with a top. It is an additional objective of my invention to provide a top in a way so as not to interfere with normal tub or shower fabrication on a male mold. The objective is accomplished by molding the top separately and by providing a system for joinder.

Additional objectives of my invention include: to improve the appearance of a shower or bath of the type described by providing a matching top, to eliminate conventional wall and ceiling surfaces above a shower or bath, to avoid deterioration of such surfaces by high moisture conditions and to provide substitute surfaces that are not injured by moisture and are readily cleaned, and to provide the product described in a structure that is economical and easily installed.

My invention will best be understood, together with further advantages and objectives thereof, from the following description, read with reference to the drawings, in which.

I wish to make clear the variety of bathroom installation and facility to which my improvement applies. I am not concerned with a tub, shower or combination tub-shower having tile applied to back and end walls during installation, or having other back and end wall treatment applied during installation. Instead, I am dealing with an existing type of prefabricated, one-piece bathing facility in which back and end walls are prefabricated and set in place. Neither am I concerned with a prefabricated shower stall (usually of right-rectangular disposition) set into a wall nor with a tiled shower stall built by hand into a wall.

Figure 1:
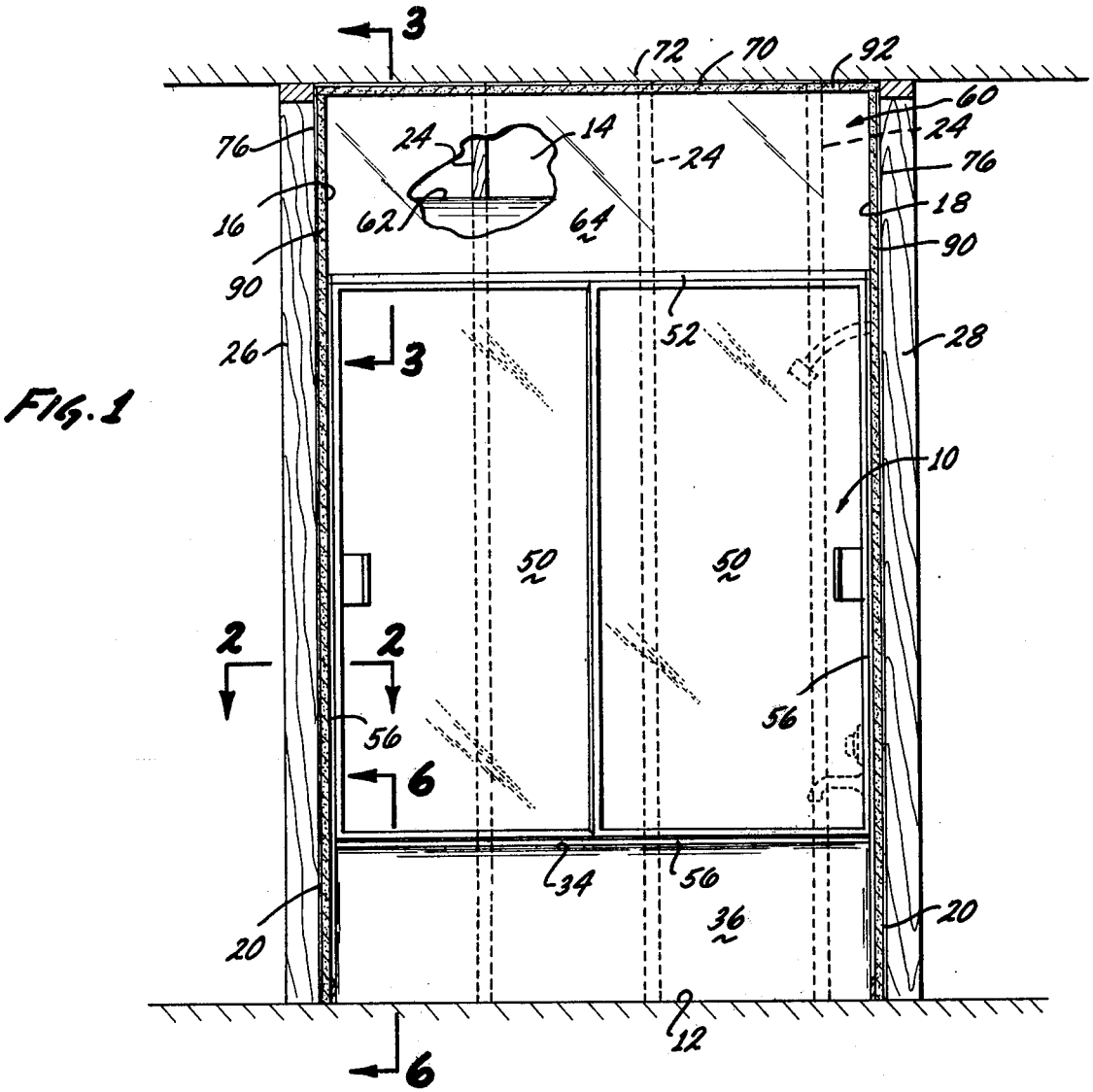
FIG. 1 is a front elevational view of a specific embodiment of my new improvement in a bathing facility. Some bathroom structure is also viewed, partly in section, and a portion of the bathing facility is broken away to show hidden structure.
Figure 2:
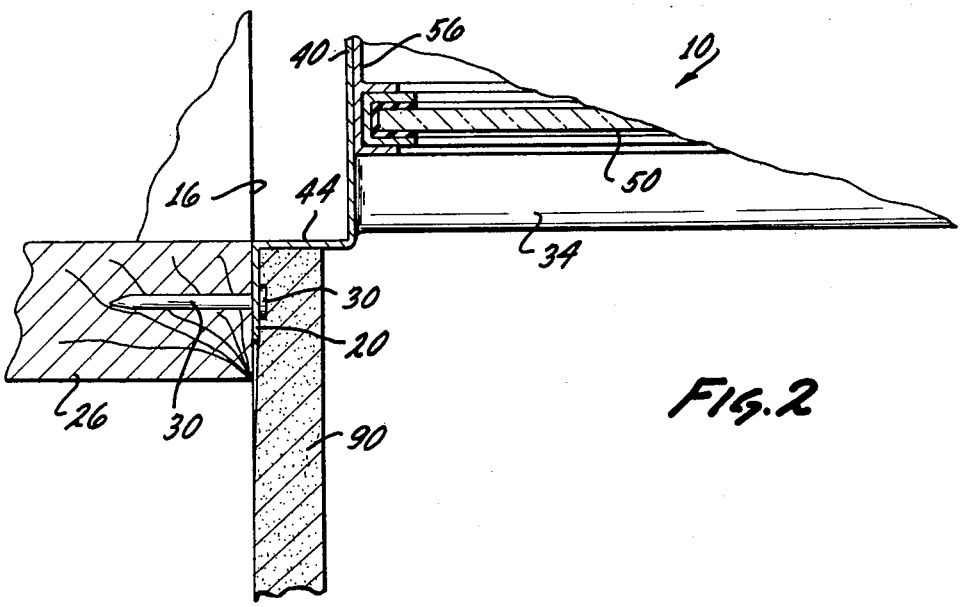
FIG. 2 is a fragmentary, enlarged view, partly in section, taken on line 2—2 of FIG. 1.
Figure 6:
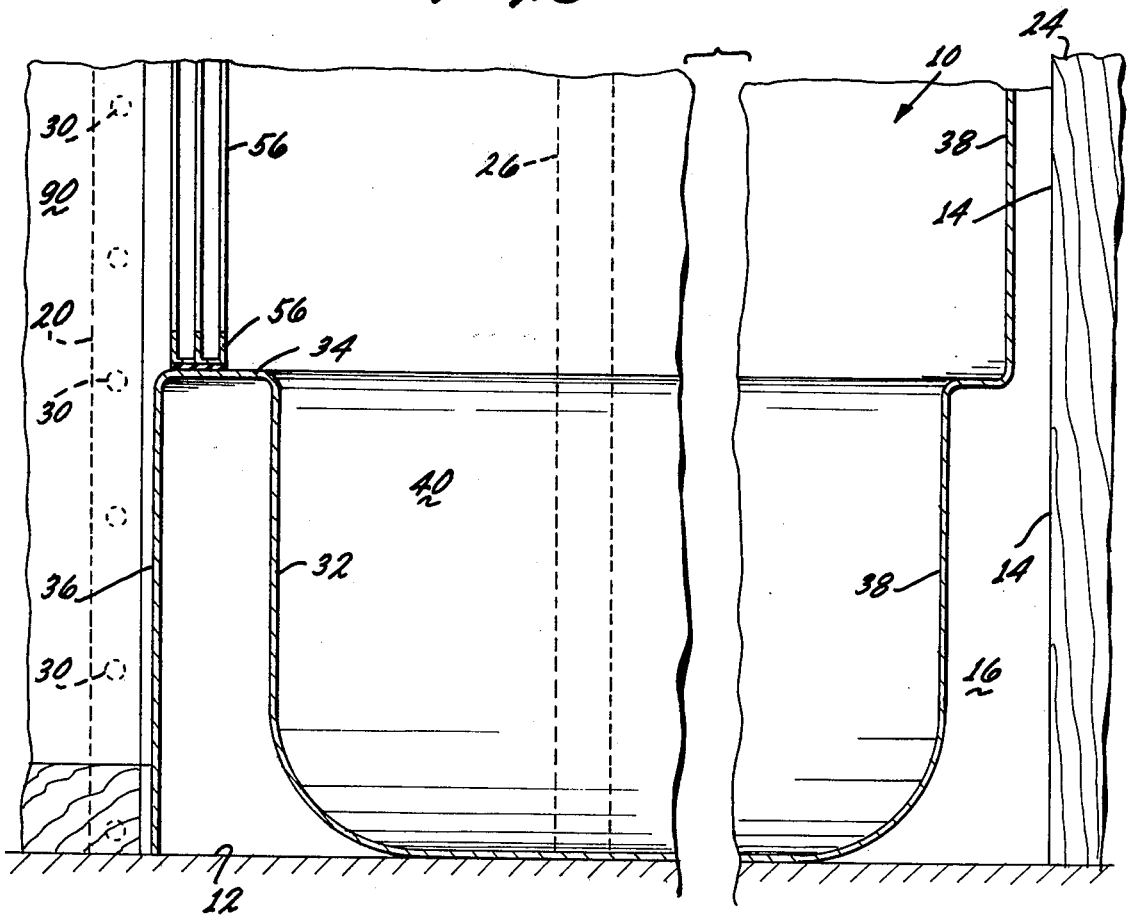
FIG. 6 is a view, partly in section, taken on line 6—6 of FIG. 1.

In order to particularly point out the type of structure I am improving upon, I have shown considerable of that construction in the drawings. The structure shown in FIGS. 2 and 6, most of the structure below a location about at the rail in FIGS. 1, 3 and 4, and part of the structure in FIG. 4, are all details of prefabricated, one-piece bathing facilities that have been marketed for some time. What I am doing is providing a top for that variety of bathing facility.

I will first describe this pre-existing model of bathing facility 10. It is designed to sit on the floor 12, to fit up against a back wall 14 (which is usually one of the normal four walls of a bathroom), and to fit between two end walls 16, 18 (one of which is usually one of the normal four walls of a bathroom and the other is usually a stub wall spaced from the other end wall the proper spacing to which the bathing facility is prefabricated, although it could be a one of the normal four walls of a bathroom). Bathing facility 10 is not essentially designed to be self-supporting and instead essentially rests on floor 12 and against walls 14, 16, 18. It could rest on a plywood sheet on floor 12 for support, or directly on floor joists. It fits directly against the studding of walls 14, 16, 18 and has side flanges 20 and upper flanges 22 usually nailed directly to studding, here illustrated as back wall studs 24, studs 26 in wall 16, and studs 28 in wall 18, as by nails 30.

Bathing facility 10 is totally formed of fiber-reinforced plastic, except some lumber stripping (i.e., 1×3's or 1×4's) may be used on the outside of planar walls for reinforcement (and bonded into place during molding). I would not exclude the possibility of fabrication of at least part of the facility, i.e., a tub, from enameled cast iron, but that is not the present direction of the art, and would make for some difficult joinder problems between tub and back and end walls. As noted before, this bathing facility is prefabricated in a factory and is set in place, as one piece, during building construction. The common units are showers and combination showers and tubs, which is the unit depicted here, including the inner tub portion 32, the rim 34, the outer wall 36 (which may be thicker and not have a flange at its foot), back wall 38, and end walls 40. Back wall 38 and end walls 40 usually are spaced from studding 24, 26, 28 and have intermediate flange portions 42 connecting with upright flanges 22 that are nailed to the studding. End walls 40 likewise may have intermediate flange portions 44 connecting with flanges 20.

Bathing facility 10 is fabricated on a male mold with a releasable surface. A finish coating is first applied that later becomes the inside, exposed surface of the facility. Then a succession of layers of fiber-reinforcing are applied together with resin until the desired thickness is built up. It will be understood that the parts around the male mold make no problem in withdrawal from the mold, i.e., the facility can be withdrawn from the mold in a direction away from tub 32. Flanges 20, 22 usually do not have the finish coating, as they are concealed in use and they may be somewhat thinner than the remainder of the body. A tub-shower combination has the same construction except that a shallow basin is substituted for the deep tub 32, which means that rim 34 and front wall 36 are only a few inches high.

Shower doors 50, supporting rail 52 (extrusion having lower flanges 54 forming tracks) from which doors 50 are suspended, and the usual double-channel bottom and side guides 56 are commonly manufactured by different plants than those manufacturing plastic bathing facility 10 and are not integrated into the design of facility 10 in usual practice. Rail 52 commonly will not be exactly aligned with flanges 42 in prior installations, and flanges 42 are as much as six to eight inches lower on occasion. Rails 52 are usually secured to the walls above facility 10, so that the top of rail 52 and flange 42 do not appear to have been disposed at exactly the same level in prior practice. In my new design, however, the top of rail 52 preferably is at the same level as the top of flange 42, for reasons that will be evident. The type of conventional bathing facility I have been describing has back and end walls 38, 40 extending upwardly to near the level of rail 52, and there will be no difficulty in the future in specifying that the tops of rail 52 and flanges 42 be at the same level in units built according to my invention.

I will now describe my improvement in the form of a top unit 60, its integration with bathing facility 10, and its installation in a bathroom. Unit 60 is prefabricated as one unit in the factory. As before indicated, a difficult molding problem would be presented if it were to be built as one piece with facility 10, i.e., a male mold would have to be designed that is collapsible or segmented in order to withdraw from the dome 62 of top 60, from the tub or basin 32 of facility 10, and from out of the space defined by walls 38, 40, if facility 10 and top 60 were to be prefabricated as one unit.

Unit 60 is fabricated in the same way above described in connection with facility 10, i.e., built over a male mold, a first finish coating applied, successive layers of fiber-reinforcement and resin, concealed flanges not needing a finish coating, etc. I have not shown strips of lumber bonded in place in the process of lay-up, reinforcing planar portions of facility 10, and I will not do so in connection with top unit 60, other than to observe that, depending on wall thickness, this could be an expedient, i.e., one or more strips longitudinally of dome 60 and one or more strips longitudinally of outer wall 64. Regarding reinforcement, in addition to the question of wall thickness, note that dome 62 does not support weight, a dome is essentially a self-supporting shape, the dome has peripheral flanges, wall 64 has flanges, etc., which would tend to be self-supporting without strip type reinforcement.

A function of dome 62 is for head room. Usually rail 52 will not be high enough for a tall person to stand in a tub or shower unless a top unit is domed above rail 52. Of course rail 52 could be made higher, but this would require longer, more expensive doors 50. It is believed that the best solution is to build dome 62 high enough for tall persons but not to try to raise rail 52 high enough so that a flat top can be used.

Figure 5:
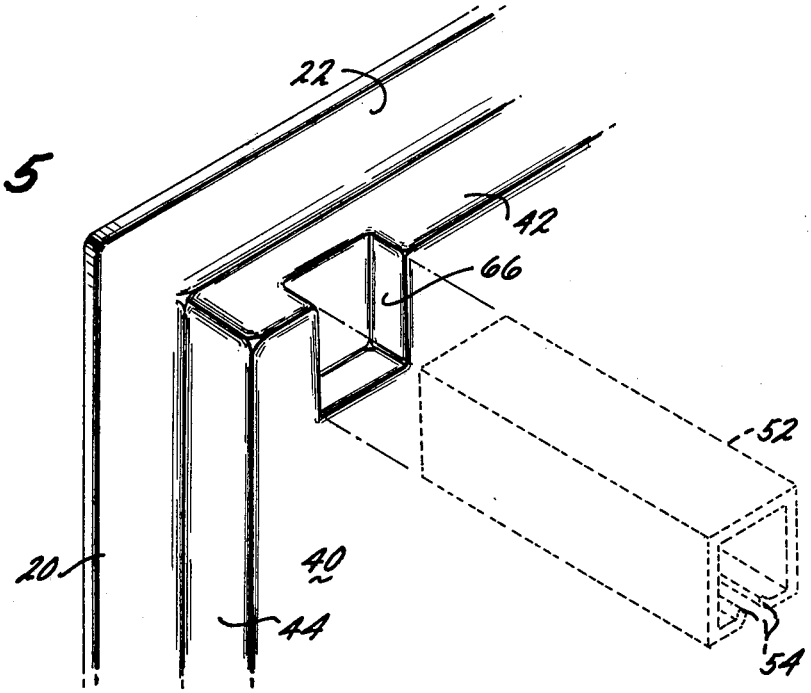
FIG. 5 is an enlarged perspective view of portions of the structure.

I have modified the standard bathing facility in one respect and that is to provide a recess 66 at each end (in walls 40) to accept rail 52 (see especially FIG. 5). This recess 66 is open at its top, which means that rail 52 can be installed merely by first installing bathing facility 10 in place, putting rail 52 in place without a requirement of other securing, and then putting top unit 60 in place on top of facility 10 and rail 52. Rail 52 would be otherwise installed, i.e., by securing it to the horizontal wall surface 68 of top 60 just above it. One point is that in prior practice rail 52 was commonly secured to walls 16, 18 immediately above facility 10, and direct securing to such walls above facility 10 is no longer feasible once a top 60 is provided covering that area, unless top 60 were configured to permit direct wall securing, which does not appear to be a good expedient. The use of recess 66 could require a particular size of rail 52, unless it were made large enough to accept some range of rail dimensions and such rails were further secured in one of a number of possible ways. Doors 50 do weight rail 52 down which helps to keep it in place.

Figure 3:
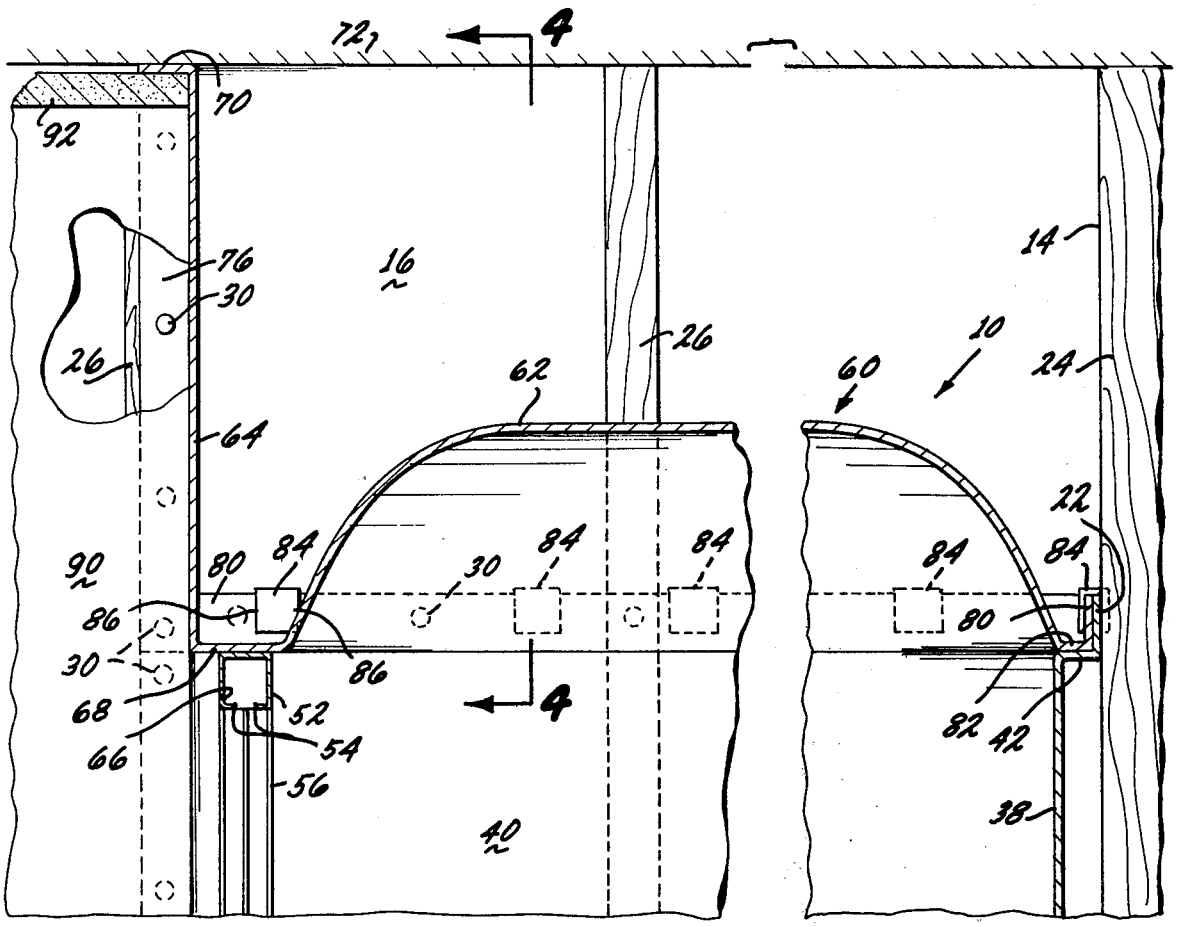
FIG. 3 is an enlarged view, partly in section, taken on line 3—3 of FIG. 1.
Figure 4:
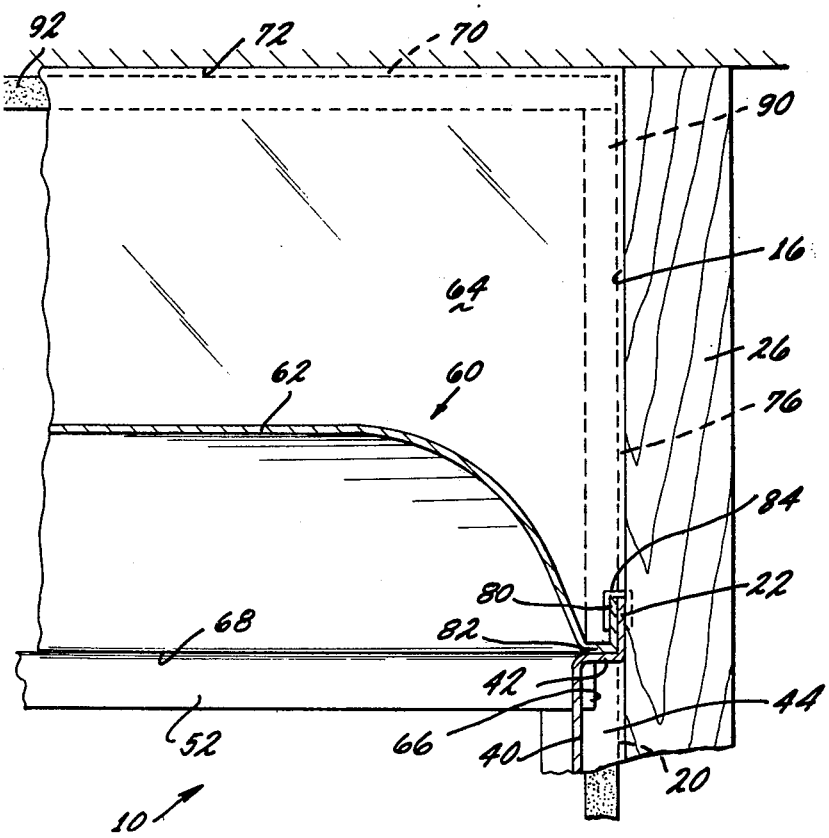
FIG. 4 is a view, partly in section, taken on line 4—4 of FIG. 3.

Top unit 60 in the FIG. 3 view is shown to have a front wall 64 with a top flange 70 that is nailed to a ceiling joist or joists 72 (depending on the direction of the joists). Front wall 64 also has side flanges 76 nailed to studs 26, 28. Front wall 64 connects to horizontal section 68 above rail 52 and then the plastic sheet material bends upwardly to form dome 62. Manufacturing tolerances could result in minor spacing between wall 68 and rail 52 and wall 68 could be lipped in front of rail 52 and/or a sealant could be applied therebetween.

Dome 62 has upright flanges 80 at its edges and horizontally disposed intermediate flanges 82 between the dome and flanges 80. Upright flanges 80 about against flanges 22 of facility 10 and horizontal intermediate flanges 82 rest on horizontal intermediate flanges 42 of facility 10. Flanges 80 can be secured to flanges 22 by spaced U-shaped clips 84, made of spring stock and having their lower sections slightly spread during installation. Clips 84 can also have some struck out (inwardly projecting) spurs 86 to engage in the plastic flanges to help secure the clips in place. Actually, dome 62 does not need much to secure it in place by the way of flange securement. Access is difficult in most places, however, to secure the flanges by nailing in the manner of flanges 22. A sealent could be applied between abutting flanges. If an adhesive were used between flanges 42, 82, flange 80 and clips 84 might not be needed.

Plasterboard sheets 90 normally will cover flanges 76, 20 on walls 16, 18. Likewise, the ceiling treatment, such as plasterboards 92, will cover the flange 70 of upright wall 64.

The operation of my invention has been described in the foregoing. To briefly review, my invention concerns an improvement in a bathing facility 10, that has been detailed in the drawings and description, in which a prefabricated, one-piece fiber-reinforced plastic tub and/or shower has walls extending up to about the level of a rail 52 supporting shower doors 50. Rail 52 could support a shower curtain, but doors are more common in this type of installation. This type of facility 10 is nailed to and supported by the studding of a back bathroom wall 14 and end bathroom walls 16, 18. Once facility 10 is installed in place, rail 52 is set in recess 66, and top unit 60 is set in place. Front wall flanges 70, 76 are nailed to ceiling joist 72 and studding 26, 28. Dome flanges 80 are secured to flanges 22 of bathing facility 10 by clips 68. Dome 62 provides sufficient headroom above rail 52 for a tall person. No wall finish operations are needed above top unit 60, i.e., it can be applied to bar framing. Note that cutting and fitting sections of plasterboard to this space, in the absence of my invention, taping the same, painting, etc., is quite time comsuming. In wall finishing operations, the cost per square foot of cutting and fitting such small areas is much higher than the cost of applying plasterboard to regular wall areas, so the labor saving is greater than is represented merely by the area of the four surfaces (end walls, rear wall and ceiling above facility 10). Particularly taping and painting operations above facility 10 may result in extra messing of facility 10 adding to a later cleaning problem at the end of building construction. Top unit 60, of course, seals facility 10 against loss of warm and moisutre-laden air passing upwardly and outwardly above rail 52, so that such losses will be restricted to leaking around and between shower doors during bathing and to exhaust when shower doors are opened after bathing. Although it is a concern of a home owner rather than a builder, deterioration of paint or even need for plasterboard or taping repairs, in a bathroom, is most likely to occur in the surfaces above a bathing facility 10, so top unit 60 also will be beneficial to the home owner in avoiding deterioration of wall surfaces above bathing facility 10.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. The improvement in a bathing facility factory manufactured separately and placed in an end of a bathroom which was constructed as part of a building, comprising:

(a) said bathroom having floor members, ceiling members, and studding forming a first bathroom rear and second and third bathroom end walls meeting said rear wall at right angles, (b) a prefabricated bathing facility at least partly molded of fiber-reinforced plastic material, said facility having a top horizontal rail and a front closure supported from said rail, said facility resting on said floor members and extending upwardly to a horizontal plane near to the height of said rail and spaced from said ceiling members, said facility having a bottom and having rear and end walls molded of plastic and rising from said botton to said horizontal plane, the lower and major portions of said facility rear and end walls being spaced from said studding and said facility rear and end walls having upper, minor marginal portions extending at angles to the remainders of those facility walls to meet said studding and said upper marginal portions ending in upwardly-directed flanges secured to said studding, (c) a prefabricated body formed of sheet-like, fiber-reinforced plastic material and molded as one piece and forming a top for said bathing facility, said body being formed separately from said bathing facility and being connected thereto during installation in said bathroom, (d) said body including an upright wall molded as a unitary part of said body extending substantially vertically from said ceiling members to the top of said rail and from said second to said third bathroom end wall, said upright wall having a first flange at its upper edge secured to said ceiling members and having second and third flanges at the ends thereof secured to said studding of said second and third bathroom end walls, said bathroom having ceiling finishing sheet-thickness materials and wall finishing sheet materials lapping and concealing said first flange and said second and third flanges respectively, (e) said body extending from a forward portion near said rail rearwardly and ending in rear and end portions substantially meeting the upper margins of said rear and end walls of said bathing facility substantially at said horizontal plane and together therewith forming rear, end and top watertight walls for said bathing facility, said body being domed between its forward and rear portions with the central portion thereof higher than said forward and rear portions thereof, and (f) said ceiling members and said studding being unfinished above, to the rear of and to the ends of said body, said bathing facility and said body together forming the finish for said end of said bathroom.

2. The subject matter of claim 1 in which said bathing facility has a recess at the forward portion of each end wall open to the upper edge thereof and generally fitting the sides and bottom of the ends of said rail and said body abutting the top of said rail, whereby said rail is secured in said recesses and supported by the bottom portions of said recesses.

3. The subject matter of claim 1 in which said rear and end portions of said body have flanges lapping and secured to said upwardly-directed flanges of said rear and end walls of said bathing facility.

4. The subject matter of claim 3 in which said rear and end portions of said body are spaced from said rear and end bathroom walls except at their lower margins which have angled lower marginal portions which abut and lap said upper marginal portions of said facility rear and end walls, said flanges on said rear and end portions of said body being upturned from said lower marginal portions of said rear and end portions of said body.

5. The subject matter of claim 4 in which there are clips securing said upwardly - directed flanges of said rear and end walls of said bathing facility to said flanges upturned from said lower marginal portions of said rear and end portions of said body.

6. The subject matter of claim 1 in which said top of said rail is at the same level as said upper marginal portions of said facility rear and end walls.

7. The improvement in a bathing facility factory manufactured separately and placed in an end of a bathroom which was constructed as part of a building, comprising:

(a) said bathroom having floor members, ceiling members, and studding forming a first bathroom rear and second and third bathroom end walls meeting said rear wall at right angles, (b) a prefabricated bathing facility at least partly molded of fiber-reinforced plastic material, said facility having a top horizontal rail and a front closure supported from said rail, said facility resting on said floor members and extending upwardly to a horizontal plane near to the height of said rail and spaced from said ceiling members, said facility having a bottom and having rear and end walls molded of plastic and rising from said bottom to said horizontal plane, the lower and major portions of said facility rear and end walls being spaced from said studding and said facility rear and end walls having upper, minor marginal portions extending at angles to the remainders of those facility walls to meet said studding and said upper marginal portions ending in upwardly-directed flanges secured to said studding, (c) a prefabricated body formed of sheet-like, fiber-reinforced plastic material and molded as one piece and forming a top for said bathing facility, said body being formed separately from said bathing facility and being connected thereto during installation in said bathroom, (d) an upright wall of sheet-like material extending substantially vertically from said ceiling members to the top of said rail and from said second to said third bathroom end wall, (e) said body extending from a forward portion near said rail rearwardly and ending in rear and end portions substantially meeting the upper margins of said rear and end walls of said bathing facility substantially at said horizontal plane and together therewith forming rear, end and top watertight walls for said bathing facility, said body being domed between its forward and rear portions with the central portion thereof higher than said forward and rear portions thereof, and (f) said ceiling members and said studding being unfinished above, to the rear of and to the ends of said body, said bathing facility and said body together forming the finish for said end of said bathroom.

8. The subject matter of claim 7 in which said bathing facility has a recess at the forward portion of each end wall open to the upper edge thereof and generally fitting the sides and bottom of the ends of said rail and said body abutting the top of said rail, whereby said rail is secured in said recesses and supported by the bottom portions of said recesses, said top of said rail being at the same level as said upper marginal portions of said facility rear and end walls.

9. The subject matter of claim 7 in which said rear and end portions of said body having flanges lapping and secured to said upwardly-directed flanges of said rear and end walls of said bathing facility.

10. The subject matter of claim 9 in which said rear and end portions of said body are spaced from said rear and end bathroom walls except at their lower margins which have angled lower marginal portions which abut and lap said upper marginal portions of said facility rear and end walls, said flanges on said rear and end portions of said body being upturned from said lower marginal portions of said rear and end portions of said body.

11. The subject matter of claim 9 in which said upright wall has flanges at the ends thereof secured to said studding of said second and third bathroom end walls, said bathroom having wall finishing sheet materials lapping and concealing said flanges of said upright wall.

* * * * *